United States Patent [19]

Ferron

[11] Patent Number: 4,515,060

[45] Date of Patent: May 7, 1985

[54] WIND INSTRUMENT WITH ADJUSTABLE TONE

[76] Inventor: Ernest Ferron, 14 rue Massacre, Rouen, France, 76000

[21] Appl. No.: 459,320

[22] Filed: Jan. 20, 1983

[30] Foreign Application Priority Data

Jan. 22, 1982 [FR] France ..... 82 0123

[51] Int. Cl.[3] ..... G10D 7/00

[52] U.S. Cl. ..... 84/380 R; 84/386; 84/387 R

[58] Field of Search ..... 84/380, 382, 383 R, 84/385, 386, 387 R, 394, 398, 399, 330, 349–350, 384

[56] References Cited

U.S. PATENT DOCUMENTS 1,621,608 3/1927 Slechta ..... 84/383 R 3,783,732 1/1974 Ihara ..... 84/385 R

FOREIGN PATENT DOCUMENTS 739888 1/1933 France ..... 84/398

*Primary Examiner*—Lawrence R. Franklin

*Attorney, Agent, or Firm*—Louis E. Marn

[57] ABSTRACT

Wind instrument of the type with mouthpiece, single reed, double reed, lip, etc. . . , comprising a device for laterally perturbing the column of air, adapted to modify the volume of a given section of the column of air, and constituted by a piston slidable inside a body disposed laterally with respect to the column of air and issuing therein, the end of the piston which faces the column of air being displaceable due to a threaded assembly inside the body and being able to project out of said body by encroaching on the said column of air.

5 Claims, 7 Drawing Figures

WIND INSTRUMENT WITH ADJUSTABLE TONE

The present invention relates to wind instruments, of the type comprising, upstream, a wave-generating device, such as the mouthpiece of a trumpet, the single reed in a clarinet or saxophone, the double reed in an oboe, the lip, etc . . . , with, downstream, a pipe for the development of stationary waves, and having a different name depending on the instruments.

The physics of these instruments have given rise to very complex researches, considering the number and undefined nature of the factors involved in making out and receiving a sound.

For example, in the structure of musical instruments with a mouthpiece, such as the trumpet, the sensitive parameters, i.e. the parameters having an effect on the frequency ratio (right pitch) and on the radiated spectrum (tone) are as follows:

1—Overall length of the main circuit
2—Length of the bell
3—Degree of conicity of the bell
4—Starting diameter of the bell
5—Profile of the bell bow
6—Diameter of the bore
7—Radius of curvature of the slide bows
8—Cylindrical or conical profile of the tuning slide bow
9—Relative length of the pistons slide assemblies with respect to the main circuit
10—Starting diameter of the lead pipe
11—Relative length of the lead pipe with respect to the main circuit
12—Degree of conicity and profile of the lead pipe
13—Volume of the cavity or pocket separating the tail end of the mouthpiece from where the lead pipe starts
14—Ratio of the dish of the mouthpiece to the surface of the "throat" of the mouthpiece
15—Length of the throat of the mouthpiece
16—Ratio of the diameter of the throat to the degree of conicity of the inside cone of the mouthpiece
17—Length of the inside cone of the mouthpiece
18—Profile of the inside cone of the mouthpiece
19—Nature of the metal constituting the instrument.

To this non-exhaustive list of parameters linked to the construction of the instrument, are added the following random parameters.

20—Air pressure coming out of the performer's lungs
21—Physiology of the performer and in particular tonus and ability of the performer to re-oxygenate his lip muscles
22—Acoustics of the room
23—Performances of the listener's hearing system, and his faculties of integration and musical culture.

The construction of an instrument which should combine a correct pitch with tone quality, is directed to make the best possible use of all or part of these parameters.

Reference can be made on this point to the book "Musical Acoustics" written by EARLE L. KENT published in 1977 by DOWDEN, HUTCHINSON & ROSS, INC., Stroubsburg, Pa., U.S.A., and also to U.S. Pat. Nos. 3,507,181 and 2,987,950.

The aforesaid book and documents however, propose solutions of a definite and non-modulable character (besides the conventional tuning adjustments with a tuning slide assembly). And there, the determining random factor constituted by the physiology of the performer raises a permanent problem in the treatment of musical pieces, and a system had to be found which permits to tune the instrument to the player.

Such a system needs to be easy to use by the musician, simple to produce and therefore of reasonable cost.

And this is precisely the object of the invention.

This object is reached due to the fact that the instrument is provided with a device causing a lateral perturbation of the column of air, which device comprises a piston adapted to slide inside a hollow body disposed laterally with respect to the column of air and issuing directly therein, the end of the piston which faces towards the column of air being adapted to move inside the body and even to project out of it by encroaching on said column of air, means being provided for moving very slightly the piston, so as to change the tone of the instrument without really noticeably affecting the pitch of the instrument.

The musician can thus adjust the impedance of the resonator constituted by the instrument in accordance with the impedance delivered by the lip-mouthpiece combination (in the case of the trumpet) by varying the column of the cavity which plays a part in the selection of the harmonics. It is recalled that the impedance is the resistance to the propagation of the wave inside the tube.

In other words, such an instrument makes it possible for the musician:

(1) to select the tone which he prefers,
(2) to be quite free to choose a type of mouthpiece adapted to his anatomy,
(3) to adapt the tone of the instrument to special conditions of musical works, of room acoustics, or of outside performances
(4) to obtain with a given potential of energy, an optimum sound performance.

Very small vatiations of the volume of the section of air column on which is implanted the perturbing device, induce considerable alterations of tone without however noticeably altering the pitch.

In order to ensure the easy and fine adjustment which is required, the piston is advantageously moved inside the body by way of a threaded assembly, preferably combined with a very fine reference graduation, such as for example a "Palmer" type graduation.

The Applicant has noted that it is possible with the invention to effect an easy adjustment of the tone even whilst playing the instrument and to obtain very rich tones as a result.

The tone is all that much richer that the perturbing device can be implanted virtually anywhere over the length of the column of air of the instrument with, everytime, a different result. The system can, through this, affect all or part of the tessitura of the instrument. It is even possible to place on the same instrument several devices according to the invention: for example, two devices, fitted one on the mouthpiece and the other on the tube of a clarinet, will give a virtually unlimited possibility of choice within a very wide tone range.

The invention will be more readily understood on reading the following description with reference to the accompanying drawings in which.

Figure 1:
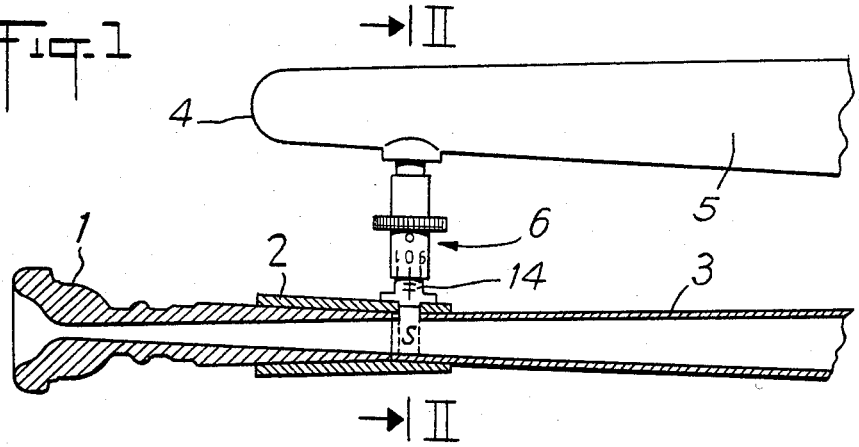
FIG. 1 is a fragmentary plan view of a partial cross-section of a trumpet, at the level of the mouthpiece, said trumpet being equipped with the adjusting device according to the invention.

FIG. 1 shows the mouthpiece 1 secured by its tailend into the barrel or mouthpiece support 2 and extended by the mouthpiece branch extended in conventional manner by the cylindrical bore of the trumpet, not shown, joining at the level of a bow 4 to the foot of the bell 5.

The air column lateral perturbation device 6 is implanted, in this particular embodiment, level with the crosspiece existing on most trumpets for joining the barrel 2 with the foot of the bell 5. This arrangement is practical but not critical, especially as the location of the device has a bearing on the changes made in the pitch: generally speaking, the harmonics affected by the device are higher, as the device is placed further upstream; the implantation of the device therefore takes into account a choice of tones preferred by the instrument factor.

Figure 2:
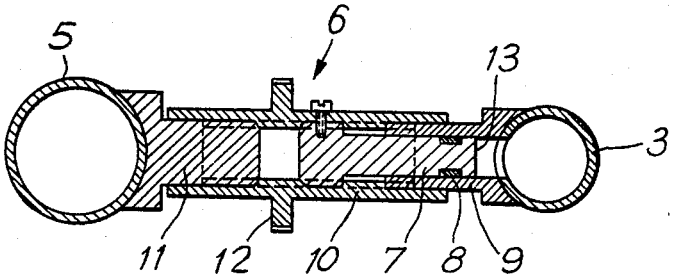
FIG. 2 is a cross-sectional view along line II—II of FIG. 1.

The device 6 illustrated in detail in FIG. 2, comprises a cylindrical piston 7 provided with a seal 8, sliding inside a hollow body 9 arranged laterally with respect to the column of air and issuing therein. The piston may be implanted perpendicularly to the axis of the column of air as shown, or more or less obliquely with respect thereto.

Said piston 7 slides inside a body 9 and is joined to a threaded sleeve 10 screwing into a threaded support 11 of the foot of the bell 5, coaxial to the body 9. A milled flange 12 makes it possible to pivot the sleeve 10 and to move the piston 7 inside the body 9. The respective dimensions of the different elements of the assembly can be calculated so that not only the piston 7 can slide and retract inside the body 9, thereby increasing the volume of the section of air column affected by the perturbing device, but also so that the end 13 of said piston can slightly project inside the said section S of the column of air and reduce the volume thereof.

A "Palmer" type graduating scale 14 makes it easy to find the adjustment corresponding to a selected tone.

The device according to the invention works for very small displacements. For example, if the thread is 0.5 mm and if the vernier contains 10 divisions, each division corresponds to a variation of the displacement of the piston of 0.05 mm. As it is easy at a glance to divide each division of the vernier into ten, it is then possible to set displacements of 0.005 mm.

A rotation of the vernier equal to the thickness of the graduating line is audible, both from the point of view of the tone and from the point of view of easiness of emission (adaptation of the impedance of the mouth-breathing system of the musician to the impedance of the instrument and to that of the room).

For a piston stroke of 5 mm (for example), it is then possible to pick out $5/0.005=1000$ different tones with a single device. Two devices give $1000^2=1{,}000{,}000$ tones, etc., this showing the great richness of tone afforded by the invention.

The artist can choose from all the different tones at his disposal, that which will offer a ready emission, a staccato precision and an optimum sound output, whilst harmonizing this tone to the style of the music played and to the style of the interpretation imposed by the conductor in the case of an orchestra.

Many variants of embodiments are of course possible for the perturbing device according to the invention.

Figure 3:
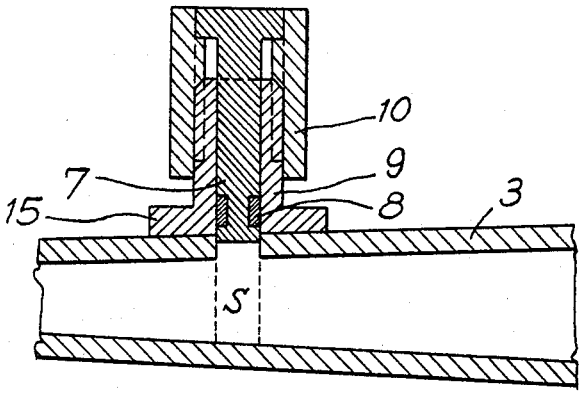
FIG. 3 illustrates another embodiment of the adjusting device according to the invention.

FIG. 3, for example, shows one such variant, wherein the device is implanted in one part of the mouthpiece branch, independently of the crosspiece joining the barrel to the bell, and wherein the rotary sleeve 10 integral with the piston 7 forms with the latter a cap-shaped control knob. The body 9 may be secured to the mouthpiece 3 by means of a welded flange 15.

Due to the lateral implantation of the perturbing device, the player can easily modify the tone of the instrument even whilst he is playing it.

One special advantage of the system according to the invention is that it is readily adaptable to all wind instruments, besides trumpets. Indeed, it requires only a lateral bore, in a spot which is a compromise between the desired acoustic effect and easy assembly.

Figure 4:
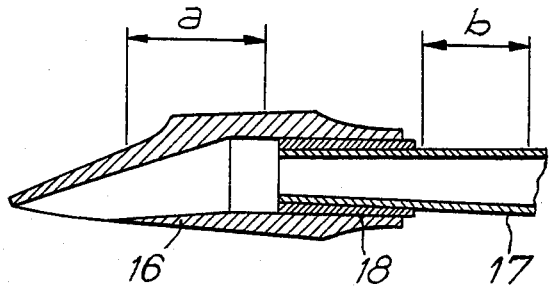
FIGS. 4, 5 and 6 show the preferred places for implanting the adjusting device according to the invention, in the case of a saxophone, a clarinet and an oboe, respectively.

For example for a single reed instrument such as a saxophone (FIG. 4) the device of the invention is preferably implanted in the area a of the mouthpiece 16, or b of the neck 17 over which fits the mouthpiece 16 via the cork 18; these areas being where access to the column of vibrating air is the easiest (only one wall, but strong enough and separate, to go through).

Figure 5:
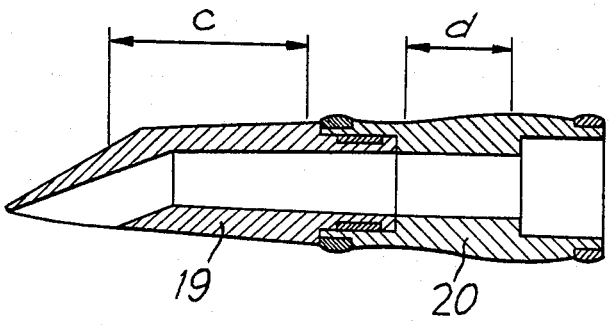
Figure 6:
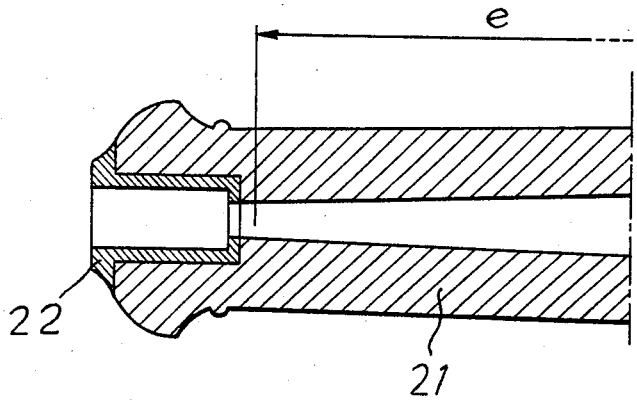

It is likewise advantageous to choose, in a single reed instrument such as a clarinet (FIG. 5) the area c of the mouthpiece 19, or d of the barrel 20.

In a double-reed instrument, of the oboe type, the device of the invention is implanted in the area e of the body 21 downstream of the fitment 22 of the reed, or on the bell-shaped neck for those double-reed instruments provided with one.

Small variations in the position of the piston, in the case of the clarinet, either reinforce or reduce the relative height of the existing harmonics, rather than add more overtones, the overall tone thus retaining a certain "familiarity" particular to the instrument, to the make, to the style of the music or of the artist, which is a great advantage in obtaining a quality tone in the pianissimo shade much sought after by musicians. The slightest variation of spectrum being clearly perceptible at the readiness of emission level, a 3 dB gain (or loss) on a harmonic presupposes a variation of energy which is double at the source (Fechner law) hence the necessity for the artist to be able to have as fine an adjustment as possible, this being the case with the invention.

Greater variations in the displacement of the piston can of course be considered, or the use of a piston of larger diameter, which will bring more contrasting tone changes by addition or substraction of overtones of higher ranges and of partials (which is an advantage for jazz or rock saxophon-players) and this in a relatively more linear manner than in the known system; but it should always be borne in mind that, with musical acoustics, sound spectra, hearing sense, a total is not perceptively the sum of its components.

Figure 7:
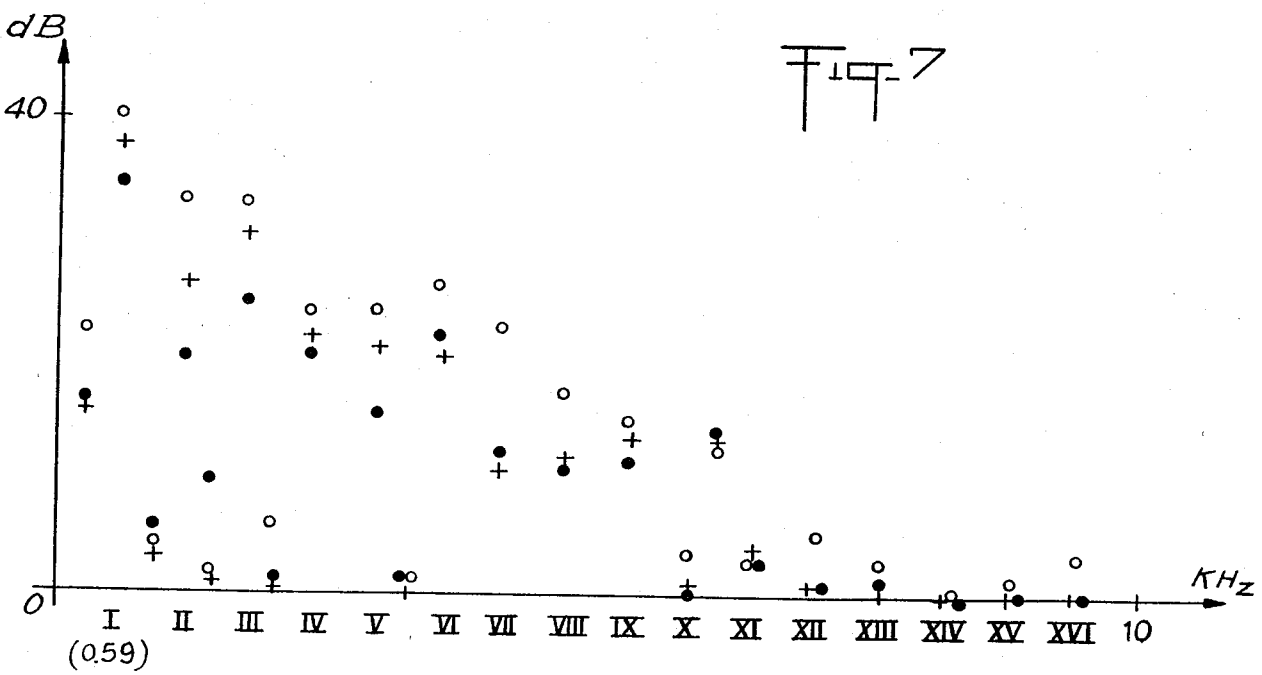
FIG. 7 is a diagram comparing the sound spectrum of one note for three different adjustments of the device according to the invention.

In order to report the changes in the sound spectrum in relation to the adjustments of the piston of the perturbing device according to the invention, records have been made with a spectrograph and a drawing table, of the sound spectrum emitted by a clarinet playing in D 5 (590 Hz), in three rather distant positions of the piston of the perturbing device. The results of these recordings are entered on the graph shown in FIG. 7, the graduations being in KHz in abscissae and in dB in ordinate. For simplification purposes, only the tops of the recording curves have been shown: a black spot indicates a result obtained with the piston retracted of 1 mm, a cross corresponds to a neutral position, and a ring to a position of the piston projecting over 1 mm inside the bore. It is clear from this figure that the retraction of the piston entails a substantial weakening of the first harmonics (I to II), whereas an advance of the piston into the bore causes the opposite, namely a reinforcement of the first harmonics, and even harmonics of a higher range.

Obviously, the invention applies to complete wind instruments or to one part thereof, since a device according to the invention can easily be adapted to one part of the instrument and commercialized in that form.

An additional advantage of the invention, which concerns, as mentioned above, both the impedance and the tone of the instrument, is the following. For reed instruments, the device according to the invention makes it possible to obtain still satisfactory results with reeds beginning to weaken. Thus the life of the reeds can be increased by 25%.

What is claimed is:

1. Wind instrument of the type with mouthpiece, single or double reed, lip, etc . . . , permitting to develop stationary waves inside a column of air, comprising a device for laterally perturbing the column of air, wherein said lateral perturbation device comprises a piston adapted to slide inside a hollow body disposed laterally with respect to the column of air and issuing directly therein, the end of the piston which faces towards the column of air being adapted to move inside the body and even to project out of it by encroaching on said column of air, means being provided for moving very slightly the piston, so as to change the tone of the instrument without really noticeably affecting the pitch of the instrument.

2. Instrument as claimed in claim 1, wherein the means for displacing the piston inside the body comprise a finely-threaded assembly.

3. Instrument as claimed in claim 2, wherein the threaded assembly is associated to a fine-graduated scale.

4. Single-reed assembly as claimed in anyone of claims 1 or 2, of the saxophon or clarinet type, wherein the lateral perturbation device is situated on the neck and/or on the barrel, respectively.

5. Double-reed instrument as claimed in any one of claims 1 or 2 of the oboe type, wherein the lateral perturbation device is situated on the body of the oboe, downstream of the fitment of the reed.

* * * * *